US012082682B1

(12) United States Patent
Zheng

(10) Patent No.: US 12,082,682 B1
(45) Date of Patent: Sep. 10, 2024

(54) BED-FLAT, STRUCTURALLY STABLE HAMMOCK AND A METHOD OF USING IT

(71) Applicant: Qinwen Zheng, Guangzhou (CN)

(72) Inventor: Qinwen Zheng, Guangzhou (CN)

( * ) Notice: Subject to any disclaimer, the term of this patent is extended or adjusted under 35 U.S.C. 154(b) by 0 days.

(21) Appl. No.: 18/379,663

(22) Filed: Oct. 13, 2023

(51) Int. Cl.
*A45F 3/24* (2006.01)
*A47C 7/66* (2006.01)

(52) U.S. Cl.
CPC ..... *A45F 3/24* (2013.01); *A47C 7/666* (2018.08)

(58) Field of Classification Search
CPC ..... A45F 3/22; A45F 3/24; A45F 3/26; A45F 4/08; A47C 7/666; A61G 7/1051; A61G 7/1055; A61G 7/1059; F16M 11/38; F16M 11/40
See application file for complete search history.

(56) References Cited

U.S. PATENT DOCUMENTS 329,631 A * 11/1885 Dillman ..... A45F 3/22 5/120
1,145,290 A * 7/1915 Bradshaw ..... A45F 3/22 5/121
1,152,006 A * 8/1915 Clarke ..... A45F 3/24 5/120
4,071,917 A * 2/1978 Mojica ..... E04H 15/04 135/96
4,597,401 A * 7/1986 Fournier ..... E04H 15/04 135/90
RE33,232 E * 6/1990 Fausett ..... A47B 47/0008 211/87.01
6,353,946 B1 * 3/2002 Steiner ..... E04H 15/04 5/120
11,889,915 B2 * 2/2024 Ressler ..... A45C 13/103
2005/0051203 A1 * 3/2005 McCully ..... A47G 9/086 135/87
2009/0065036 A1 * 3/2009 Johnson ..... A45F 3/22 135/95
2020/0046107 A1 * 2/2020 Sabbagh ..... A45F 3/22
2021/0000245 A1 * 1/2021 Rodet ..... E04H 15/02
2021/0386182 A1 * 12/2021 McMicken ..... A47C 13/00
2022/0354241 A1 * 11/2022 Ressler ..... A45F 3/24

* cited by examiner

*Primary Examiner* — Justin C Mikowski
*Assistant Examiner* — George Sun
(74) *Attorney, Agent, or Firm* — Jose Cherson Weissbrot

(57) ABSTRACT

The present invention discloses a bed-flat, structurally stable hammock, comprising at least one hammock body formed of a flexible material, at least one insect proof tent formed of a flexible material with a mesh, at least one flexible rod resiliently erected and detachably attached to the hammock body and the insect proof tent, at least two telescopic rods, each end of the hammock body forming a detachable attachment to the telescopic rods, at least one stowage bag made of a flexible, waterproof material, and at least one hood formed of a waterproof, flexible fabric blank.

20 Claims, 11 Drawing Sheets

BED-FLAT, STRUCTURALLY STABLE HAMMOCK AND A METHOD OF USING IT

TECHNICAL FIELD

The present invention relates to the technical field of outdoor goods devices, in particular to a bed-flat, structurally stable hammock and a method of using it.

BACKGROUND

Outdoor sports as close to nature, fashionable and environmentally friendly sports and leisure way, more and more people's attention, increasingly become more people's hobby. Hammock also more and more into the ranks of travel supplies, become people traveling camping indispensable essential supplies.

A hammock provides a surface suspended between upright structures (e.g., trees, posts, etc.) from which a person can be suspended above the ground. A hammock is typically made of a sheet of material, often flexible (e.g., canvas, netting, rope, etc.), which is gathered at the end and suspended from the upright structure by ways of ropes, straps, or similar devices.

But a common problem with conventional hammocks is that the user's body sinks into the hammock when lying down within the hammock, which is uncomfortable for the user because it does not follow the natural contours that the human body will take when lying down, affecting the user's sense of experience, due to the fact that the tension ropes at the ends of the hammock do not provide sufficient tension for the hammock, and the way the tension ropes are set up results in the hammock being frequently dented in use during the Phenomenon. For example, a hammock disclosed in U.S. Patent No. 20190231055 has a denting problem, and similarly, a hammock disclosed in U.S. Patent No. 20170202344 also has a denting problem.

Based on the above problems, it is necessary to invent a new hammock, which has a tension rope set up in such a way as to provide sufficient tension for the hammock, and at the same time to make the hammock more stable, and to give the user a better experience of using the hammock.

SUMMARY

The present invention provides a bed-flat, structurally stable hammock, comprising a hammock body, the hammock body having connection portion provided at each end of the hammock body, the connection portion being connected to the connection portion at an end away from the bed, the third tensioning rope forming a fixed connection with an external object, wherein the connection portion has a decreasing transverse width in a direction away from the bed:

wherein the connection portion is further provided below the connection portion with catch bar portion, the catch bar portion forming a fixed connection with the connection portion and being provided parallel to the ends of the hammock body.

At least two telescopic rods, each of the two telescopic rods being threaded through the catch bar portion, wherein the telescopic rod has a first end and a second end opposite the first end, the first end being removably coupled to a first tensioning rope, the second end being removably coupled to a second tensioning rope, and the first tensioning rope and the second tensioning rope each forming a fixed connection to the external object:

wherein the third tensioning rope has a third fixing point forming a fixed connection to the external object, the first tensioning rope has a first fixing point forming a fixed connection to the external object, and the second tensioning rope has a second fixing point forming a fixed connection to the external object, wherein the third fixing point is at an elevation not less than the elevation of the catch bar portion, the first fixing point and a second fixation point are at an elevation no greater than the elevation of the catch bar portion;

When the first tensioning rope, the second tensioning rope and the third tensioning rope form a fixed connection with the external object, a substantially triangular structure is formed between the first tensioning rope and the second tensioning rope and the third tensioning rope:

When the ends of the hammock body are tensioned by the first tensioning rope, the second tensioning rope and the third tensioning rope, respectively, the hammock body forms a bed plane which is not easily recessed.

The present invention provides a bed-flat, structurally stable hammock, comprising a hammock body, the hammock body is provided with connection portion at each end of the hammock body, the connection portion having a triangular cross-section, wherein the connection portion is connected to third tensioning rope at an end away from the bed, the third tensioning rope forming a fixed connection with an external object:

Said connection portion is further provided below the connection portion with catch bar portion, the catch bar portion forming a fixed connection with the connection portion and being provided parallel to each end of the hammock body:

At least two telescopic rods, each of the two the telescopic rods being threaded into the catch bar portion, wherein the telescopic rod has a first end and a second end opposite the first end, the first end being removably coupled to a first tensioning rope, the second end being removably coupled to a second tensioning rope, and the first tensioning rope and the second tensioning rope each forming a fixed connection with an external object;

wherein the third tensioning rope has a third fixing point forming a fixed connection to the external object, the first tensioning rope has a first fixing point forming a fixed connection to the external object, and the second tensioning rope has a second fixing point forming a fixed connection to the external object, wherein the elevation of the third fixing point is not less than the elevation of the catch bar portion, and wherein the first fixing point and the second fixing point have an elevation are not greater than the elevation of the catch bar portion;

When the first tensioning rope, the second tensioning rope and the third tensioning rope form a fixed connection with the external object, a substantially triangular structure is formed between the first tensioning rope and the second tensioning rope and the third tensioning rope;

When the ends of the hammock body are tensioned by the first tensioning rope, the second tensioning rope and the third tensioning rope, respectively, the hammock body forms a bed plane that is not susceptible to denting.

The present invention also provides a method of using a hammock comprising providing at least one hammock body, at least two telescopic poles and a plurality of tensioning ropes:

The method comprising:

Connecting two the tensioning rope to each end of the hammock body using two the tensioning rope, wherein one end of each of the two the tensioning rope away from the hammock body forms a fixed connection with an external object at each end, wherein a fixing point at which the tensioning rope forms a fixed connection with the external object is defined as a third fixing point;

setting two of the telescopic rod at each end of the hammock body:

connecting two of the tensioning rope to each end of one of the telescopic rod using two of the tensioning rope respectively, wherein one end of each of the two of the tensioning rope away from the telescopic rod forms a fixed connection with the external object, wherein the fixing points at which the two of the tensioning rope form a fixed connection with the external object are defined as a first fixing point and a second fixing point;

Tensioning a number of the tensioning rope so that the hammock body forms a flat and non-depressed plane, wherein the line between the first fixing point, the second fixing point and the third fixing point forms a substantially triangular structure.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

In the drawings.

Figure 1:
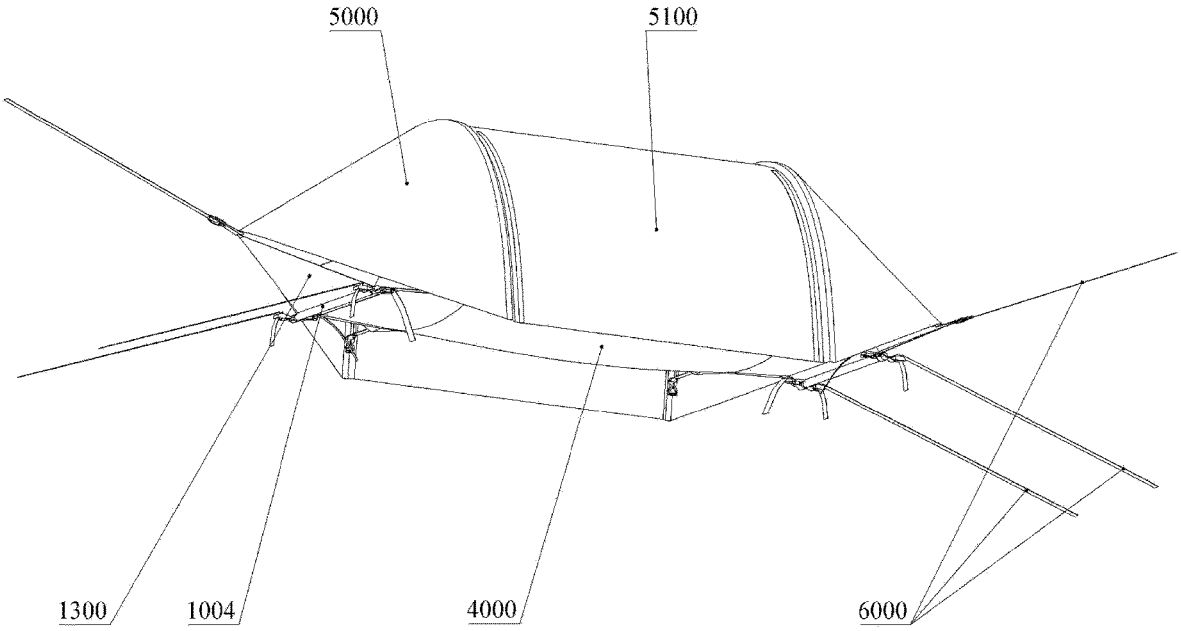
FIG. 1 shows an isometric views of a bed-flat, structurally stable hammock.
Figure 2:
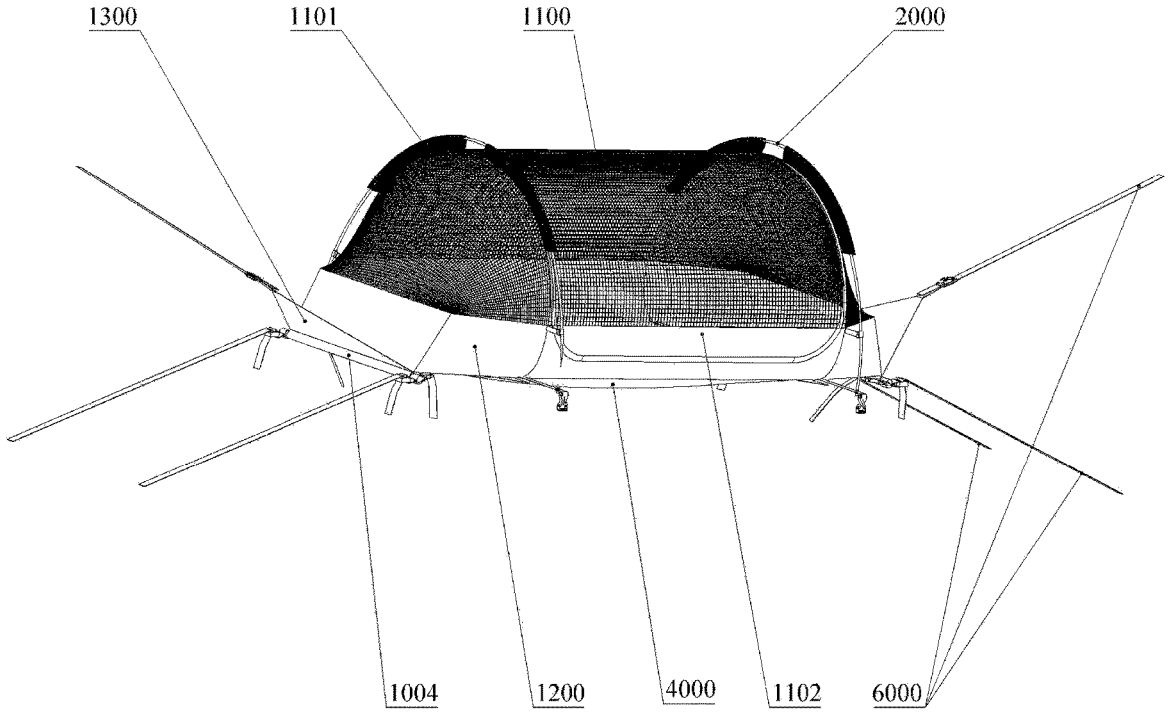
FIG. 2 shows an isometric views of FIG. 1 when there is no covering hood.
Figure 3:
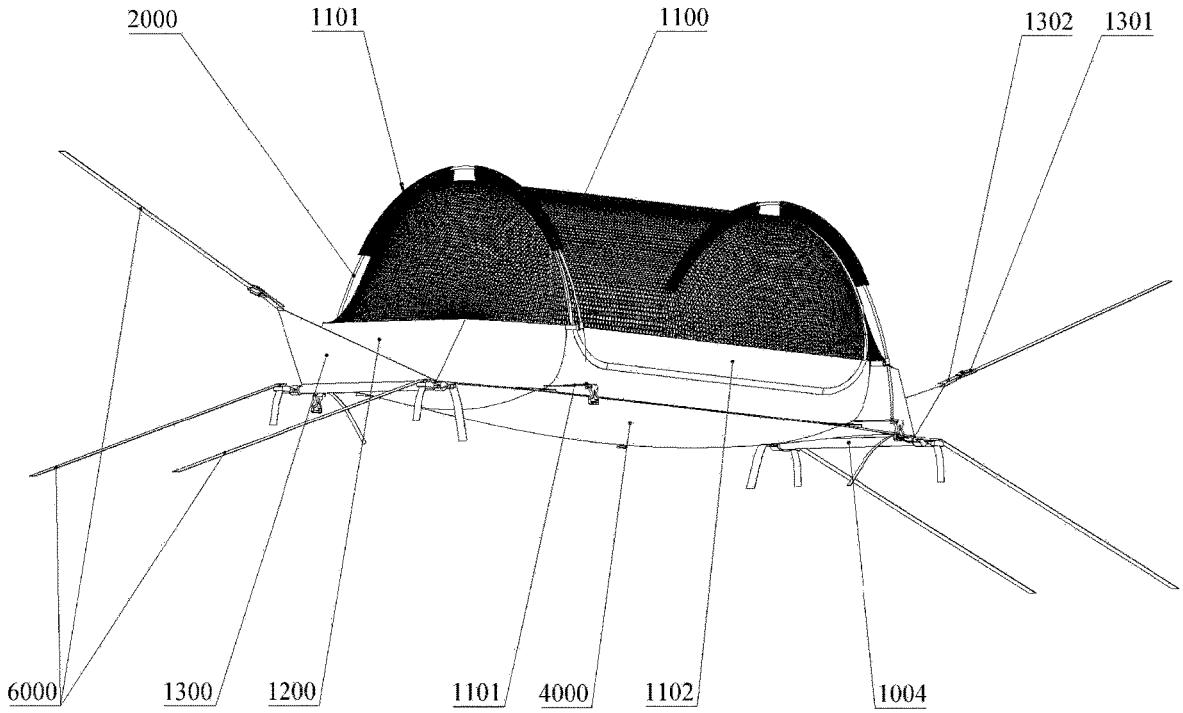
FIG. 3 shows another isometric views of FIG. 2.
Figure 4:
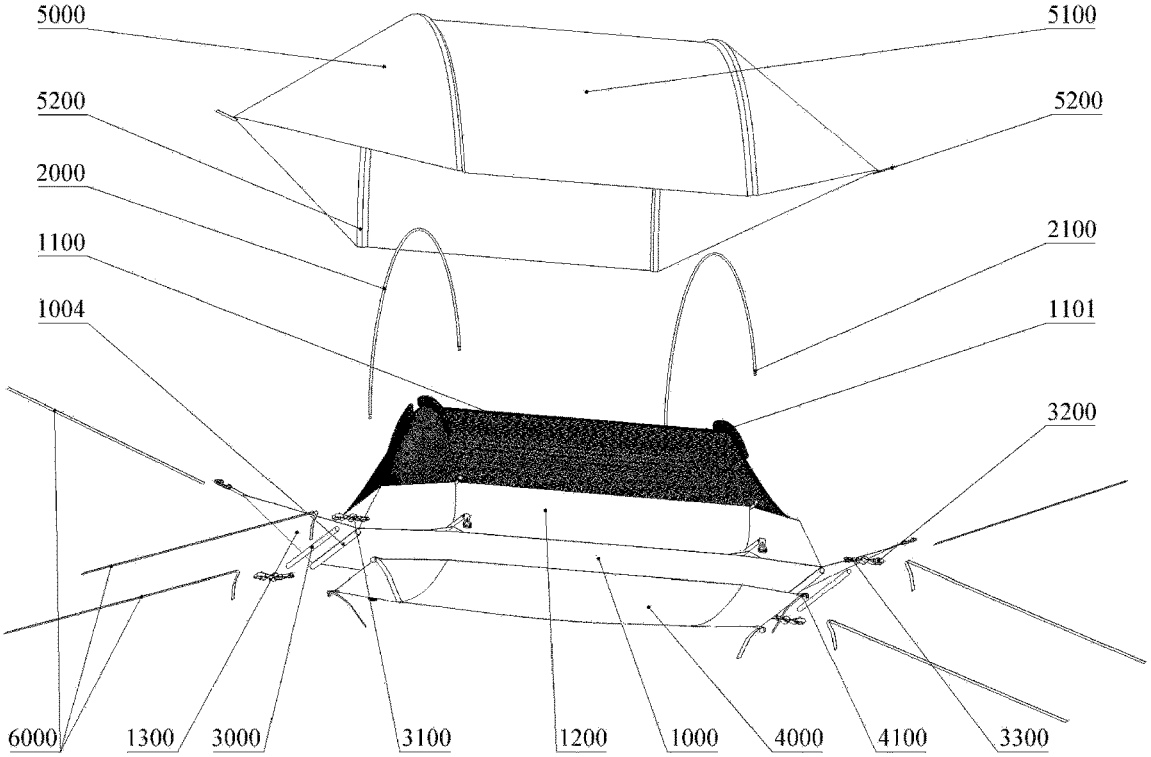
FIG. 4 shows an exploded view of a bed-flat, structurally stable hammock.
Figure 5:
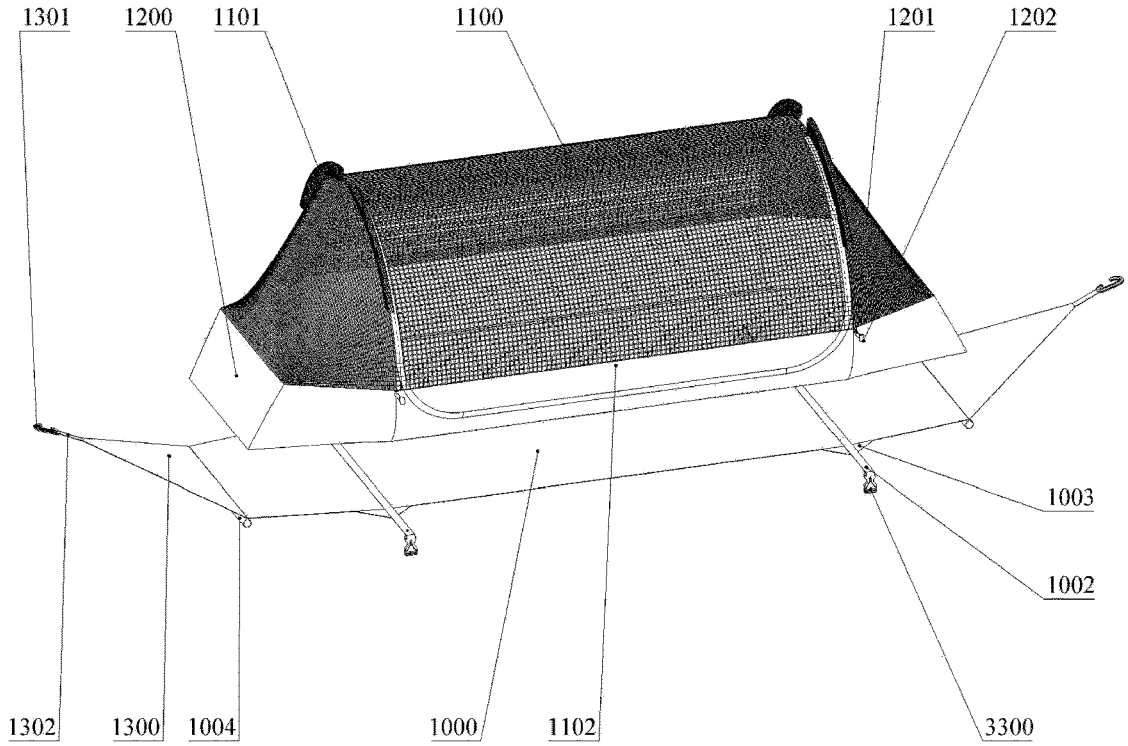
FIG. 5 shows another exploded view of FIG. 4.
Figure 6:
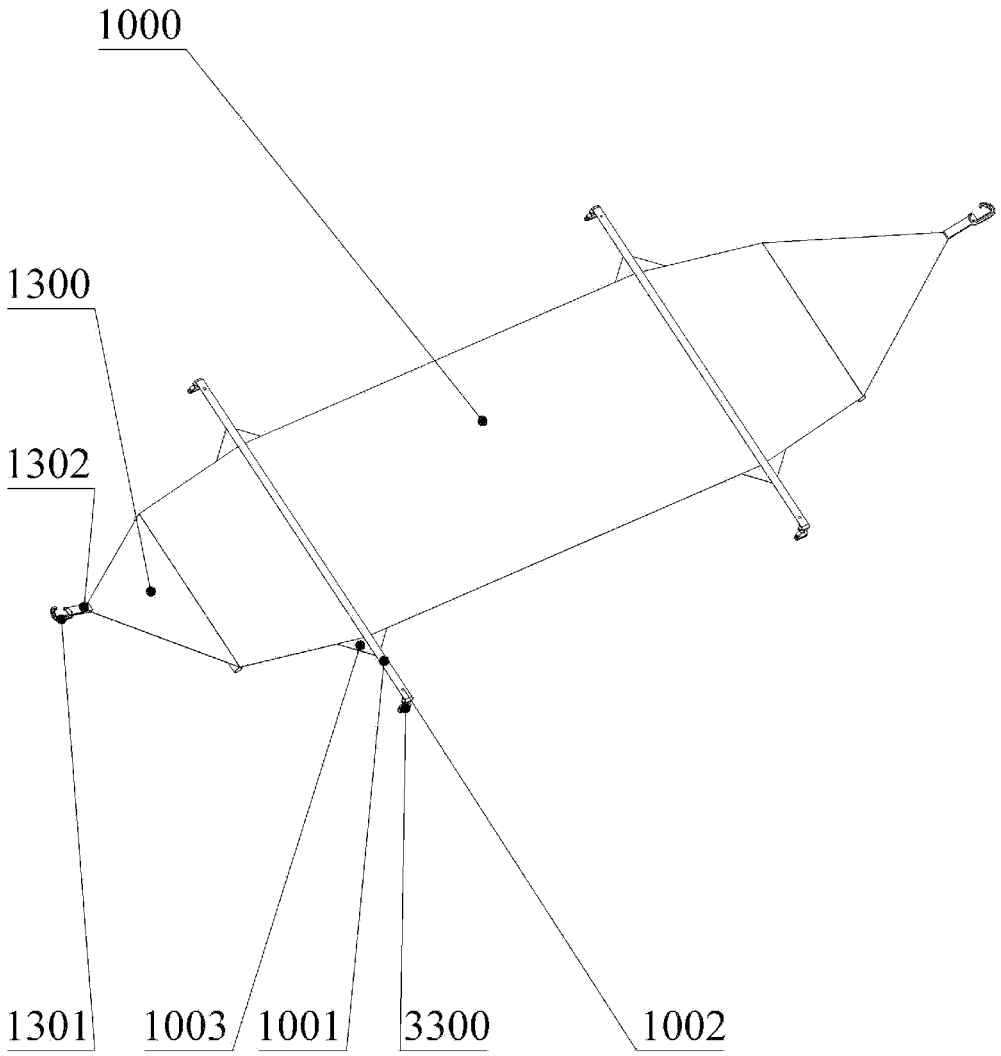
FIG. 6 shows an isometric views of a hammock body.
Figure 7:
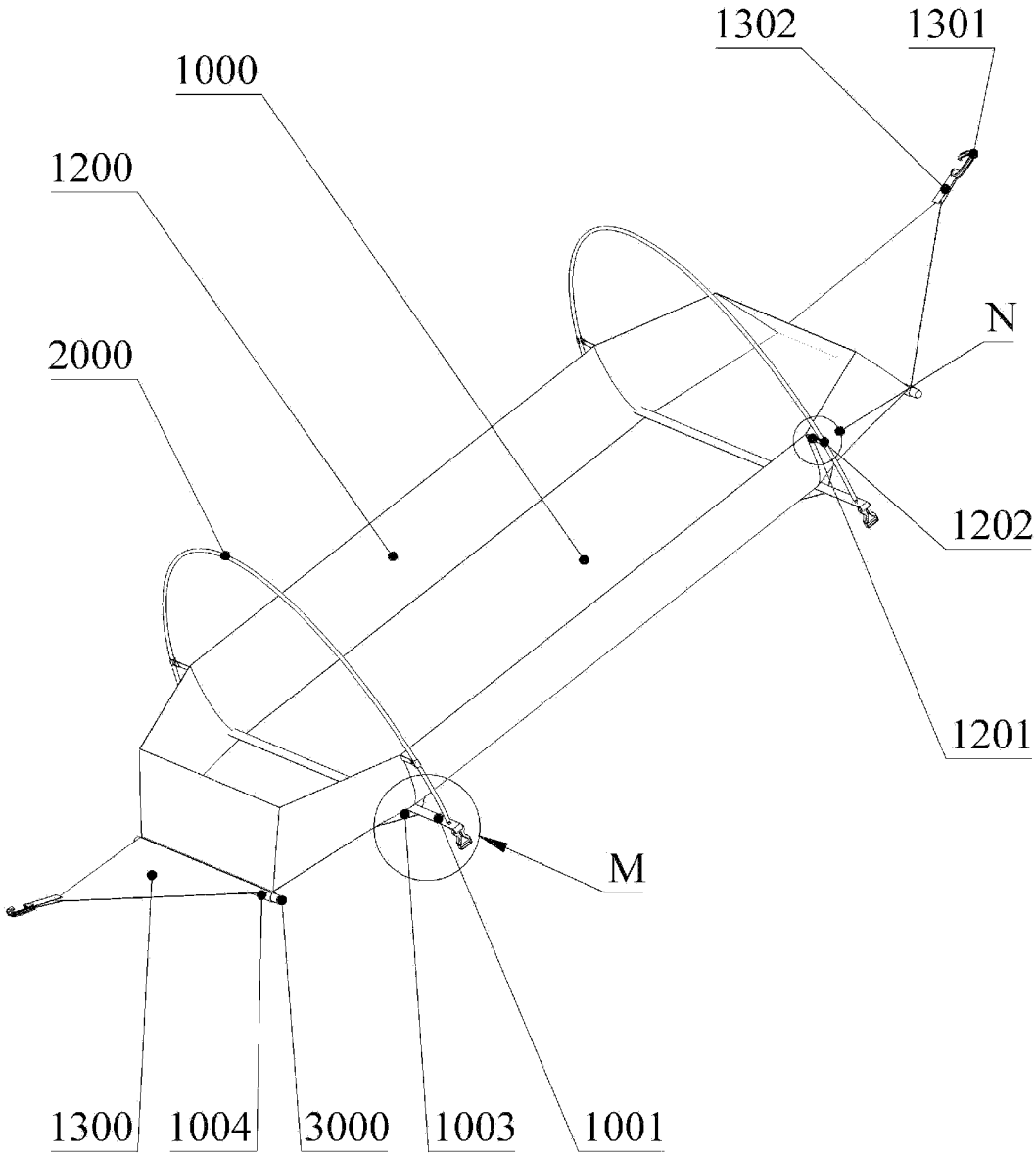
FIG. 7 shows an isometric views of the hammock body, the guardrail department, the flexible rod and the telescopic rod when combined.
Figure 8:
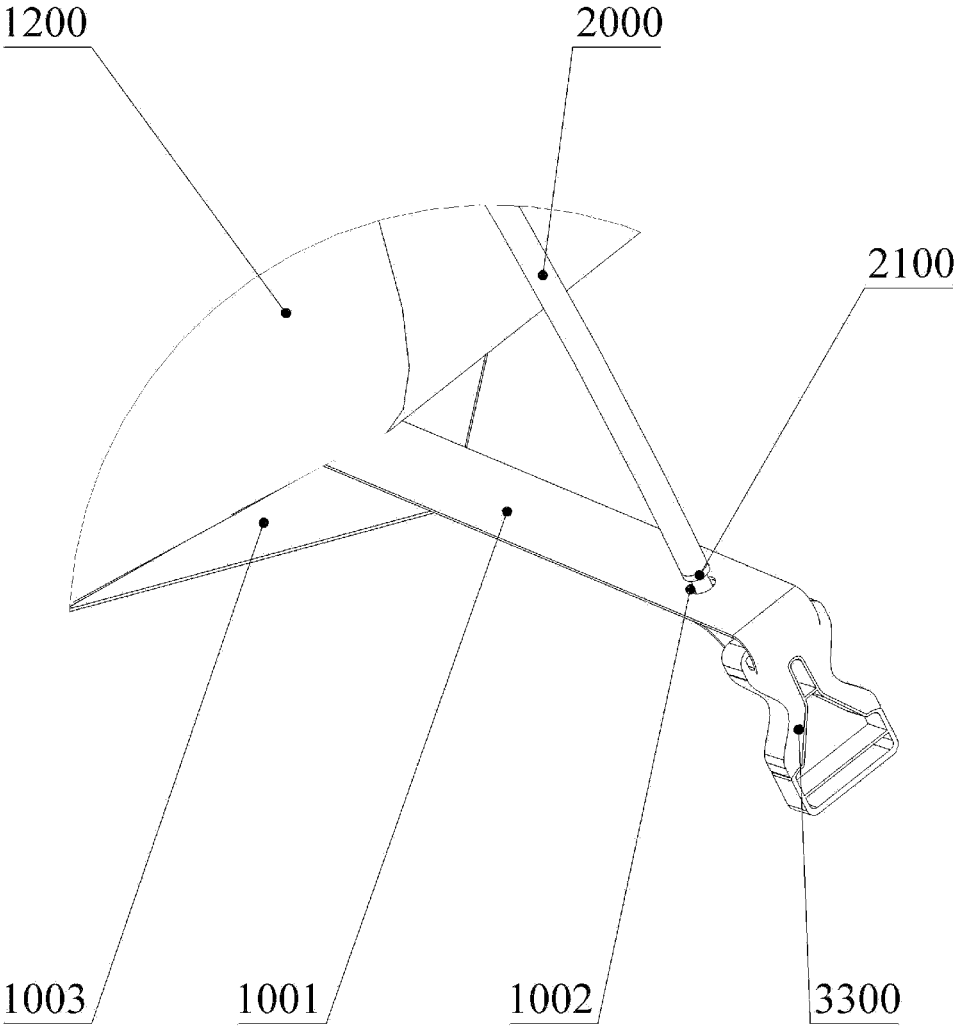
FIG. 8 shows a local enlargement at M of FIG. 7.
Figure 9:
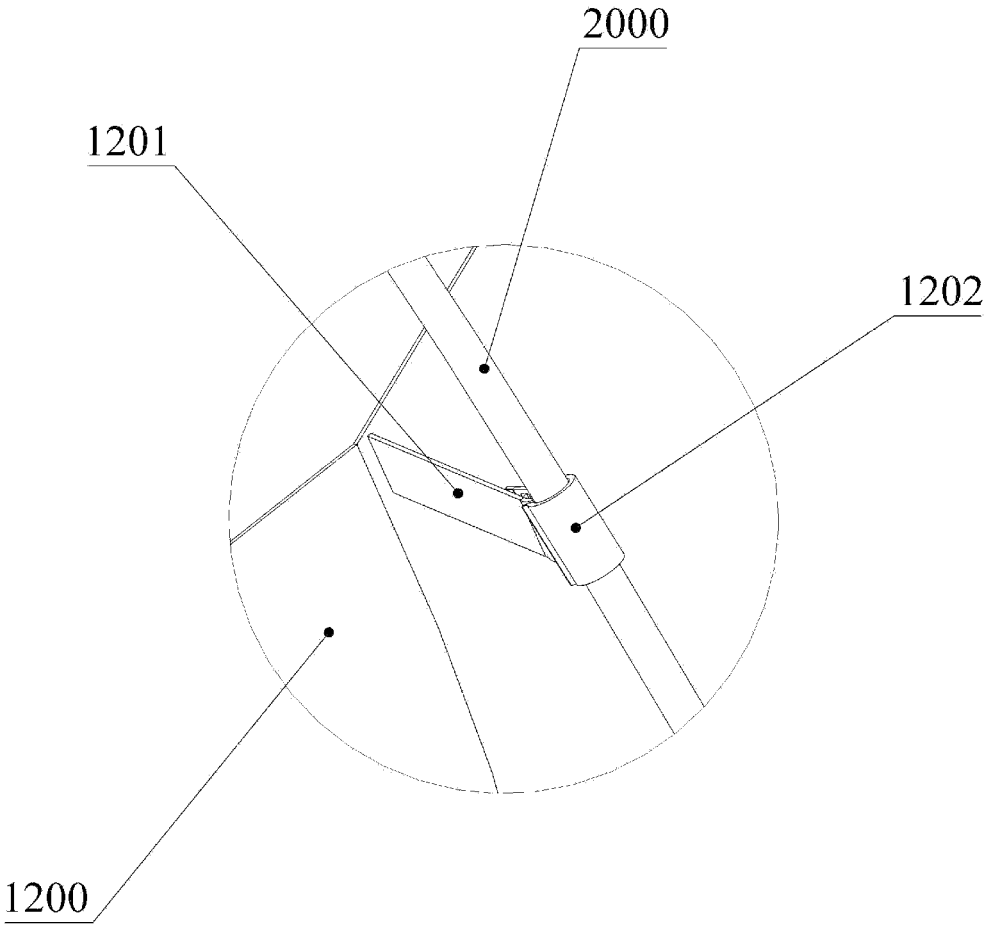
FIG. 9 shows a local enlargement at N of FIG. 7.

hammock body; 1001, stationary section; 1002, fixing hole; 1003, reinforcement division; 1004, catch bar portion: 1100, insect proof tent: 1001, support section; 1102, opening A: 1200, guardrail department; 1201, retaining ear: 1202, hook; 1300, connection portion; 1301, stopper; 1302, locking strap: 2000, flexible rod: 2100, retaining head: 3000, telescopic rod: 3100, connection cap; 3200, snap; 3300, retainer strap; 4000, stowage bag; 4100, retaining strap; 5000, hood: 5100, opening B: 5200, connection zone: 6000, tensioning rope.

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, but that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a" "an" and "the" are intended to include the plural forms as well, unless the context clearly indicates other.

As shown in FIGS. 1 to 13, the present invention provides a bed-flat, structurally stable hammock, comprising hammock body 1000, with connection portion 1300 provided at each end of hammock body 1000, and connection portion 1300 being connected to a third tensioning rope 6000 at an end of connection portion 1300 away from the bed, and the third tensioning rope 6000 forming a fixed connection with an external object, wherein a transverse width of the connection portion 1300 decreases in the direction of away from the bed:

Further provided below the connection portion 1300 is a catch bar portion 1004, the catch bar portion 1004 forming a fixed connection with the connection portion 1300 and provided parallel to the ends of the hammock body 1000;

At least two telescopic rod 3000*s*, each of the two telescopic rod 3000*s* being threaded through the catch bar portion 1004, wherein the telescopic rod 3000*s* have a first end portion and a second end portion opposite the first end portion, the first end portion being detachably coupled to the first tensioning rope 6000, the second end portion being detachably coupled to the second tensioning rope 6000, and wherein the first tensioning rope 6000 and the second tensioning rope 6000 are each formed in a fixed connection with an external object:

wherein the third tensioning rope 6000 has a third fixation point that forms a fixed connection with the external object, the first tensioning rope 6000 has a first fixation point that forms a fixed connection with the external object, and the second tensioning rope 6000 has a second fixation point that forms a fixed connection with the external object, wherein the first fixation point has an elevation that is not less than an elevation of catch bar portion 1004, and the second fixation point and the third fixation point have an elevation that is not greater than catch bar portion 1004 the elevation of the elevation of the first fixation point;

When the first tensioning rope 6000, the second tensioning rope 6000, and the third tensioning rope 6000 form a fixed connection with an external object, a roughly triangular structure is formed between the first tensioning rope 6000 and the second tensioning rope 6000 and the third tensioning rope 6000;

When the ends of hammock body 1000 are tensioned by the first tensioning rope 6000, the second tensioning rope 6000 and the third tensioning rope 6000, respectively, the hammock body 1000 forms a bed plane that is not susceptible to depression.

As shown in FIGS. 1 to 13, in this embodiment, a bed-flat, structurally stable hammock comprising at least one hammock body 1000 formed of a flexible material, at least one insect proof tent 1100 formed of a flexible material with a mesh-like pattern, at least one flexible rod 2000, resiliently erected and removably attached to the hammock body 1000 and insect proof tent 1100, at least two telescopic rod 3000*s*, with each of the ends of the hammock body 1000 formed with the telescopic rod 3000*s* detachably attached, at least one stowage bag 4000 made of a flexible waterproof material, and at least one hood 5000 formed of a waterproof flexible fabric blank.

In this embodiment, hammock body 1000 is formed from a single layer of flexible material, the flexible material providing a comfortable sleeping experience for the user. In other embodiments (not shown in the figures), hammock body 1000 is not limited to being provided with a single layer of sturdy flexible material, hammock body 1000 may also be provided with a layer of softer and more comfortable flexible material on top of the single layer of sturdy flexible material to provide higher comfort to the user: it may also be provided with a layer of flexible material on top of the single layer of sturdy flexible material that dissipates heat better, which can provide the user with a cooler using experience and can adapt to a hotter use scenarios: it is also possible to set a layer of flexible material with better heat insulation on the single layer of sturdy flexible material, which allows the user to have a warmer use experience, and can be adapted to colder use scenarios; it is also possible to set up any number of layers in accordance with the will, and any flexible material in accordance with the will of the traits on the hammock body 1000.

As shown in FIGS. 1 to 13, in this embodiment, connection portion 1300 has a triangular cross-section, at least one stopper is provided on connection portion 1300, and two ends of hammock body 1000 form a detachable attachment with the third tensioning rope 6000 via the stopper.

In this embodiment, connection portion 1300 is formed of a flexible material. In other embodiments (not shown in the drawings), it may be provided to be connected to the ends of the by two twine cords, and also to form a connection between the twine cords and by a flexible material, or to be connected to the ends of the by a chain, and also to form a connection between the chain and by a flexible material.

Specifically, connection portion 1300 is provided as an isosceles triangle in which one side of connection portion 1300 coincides with one end of hammock body 1000, locking strap is provided at one end of connection portion 1300 away from hammock body 1000, and stopper is provided on locking strap, which allows for a more balanced force on the hammock, making the hammock flatter and more durable, providing a more comfortable experience when the user is using the hammock, and enhancing the durability of the hammock.

In this embodiment, both hammock body 1000 and connection portion 1300 are formed from a flexible material, and a fixed connection is formed by stitching. In this embodiment, the stitching is machine stitching, and in some embodiments, it may also be manual stitching. In some embodiments, the connection of hammock body 1000 and connection portion 1300 is not limited to sewing, but may also be set up to be formed in one piece from the same piece of flexible material, and may also be formed by a snap 3200 connection and any other connection that meets the wishes.

In this embodiment, the ends of hammock body 1000 form a connection with the third tensioning rope 6000 via stopper. In other embodiments (not shown in the figures), the connection is not limited to a connection, but may also be set up as a connection, a bundle connection, a screw connection and any other connection that conforms to the will.

As shown in FIGS. 1 to 11, in this embodiment, catch bar portion 1004 is also provided below connection portion 1300, catch bar portion 1004 forms a fixed connection with connection portion 1300 and is provided parallel to the ends of said hammock body 1000, wherein the inner surface of catch bar portion 1004 defines a space, the space being passable through and accommodating telescopic rod 3000, and wherein the length of catch bar portion 1004 corresponds to the sides of connection portion 1300 overlapping with hammock body 1000. When telescopic rod 3000 is connected to catch bar portion 1004, two telescopic rod 3000*s* are inserted into catch bar portion 1004 to be connected to hammock body 1000.

In this embodiment, the telescopic rod 3000 is provided as two combinable rods, and the two rods are connected to each other by an elastic member, which design saves the user the space required when storing the telescopic rod 3000, and the elastic member prevents one of the rods from being lost and facilitates the assembly of the telescopic rod 3000. In this embodiment, telescopic rod 3000 is provided with two rods. In other embodiments (not shown in the figures), it may be provided with three, four, five and any other number of rods as desired.

In other embodiments (not shown in the drawings), it is not limited to being formed from a sturdy flexible material, but can also be set up to be formed from plastic, silicone, and any other material that conforms to the will. In this embodiment, the connection to hammock body 1000 is a stitched connection. In some embodiments, the connection method may also be set up as one-piece molding, Velcro, adhesive, and other arbitrary connection methods in accordance with the will.

Figure 10:
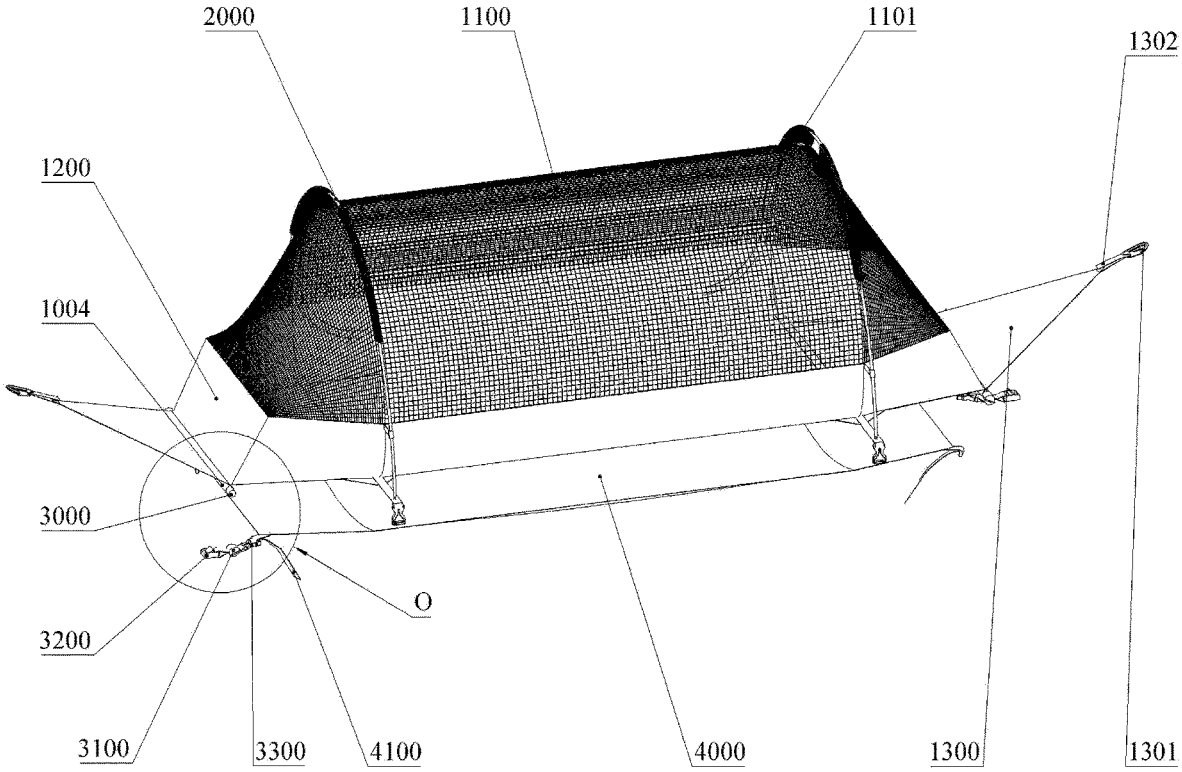
FIG. 10 shows a schematic diagram of a bed-flat, structurally stable hammock when the connection cap and the storage bag are disassembled.
Figure 11:
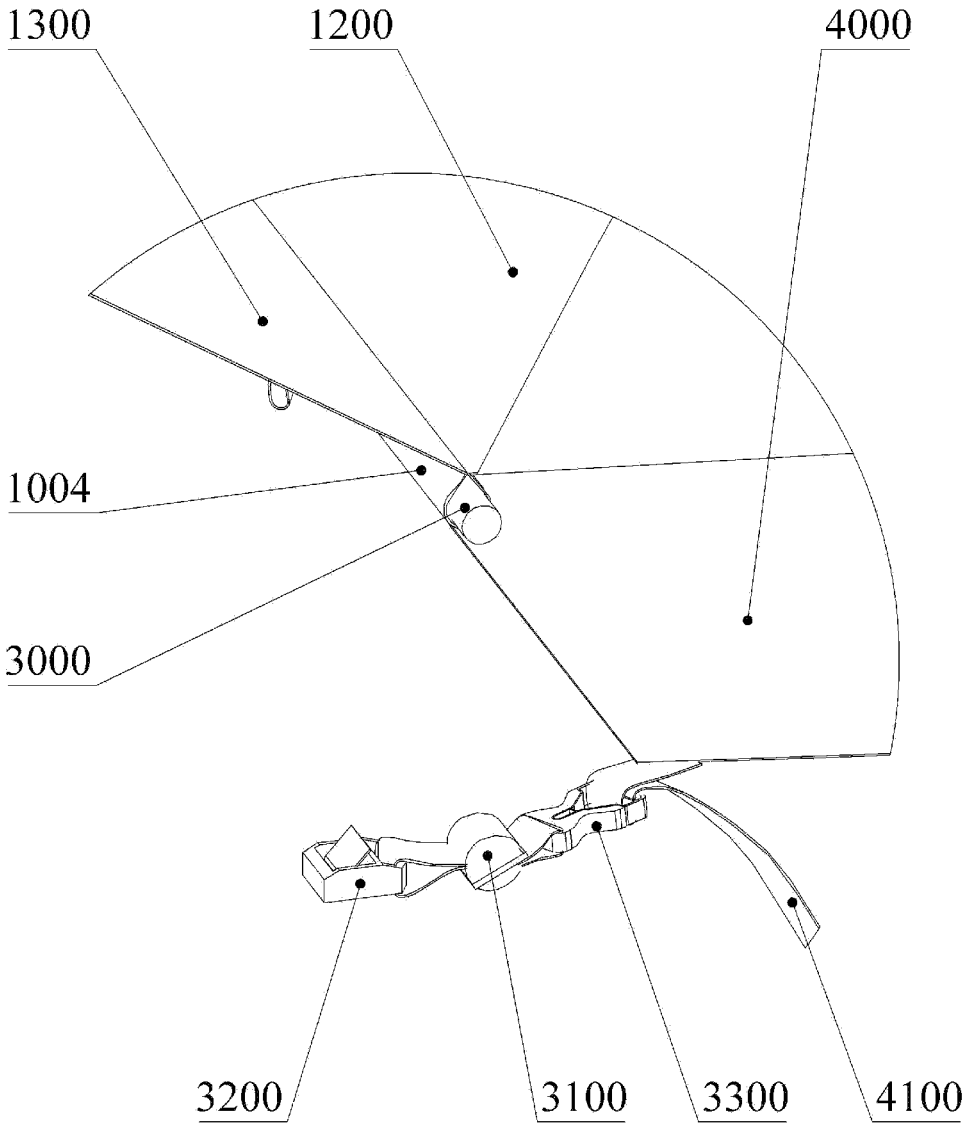
FIG. 11 shows a local enlargement at O of FIG. 10.
Figure 12:
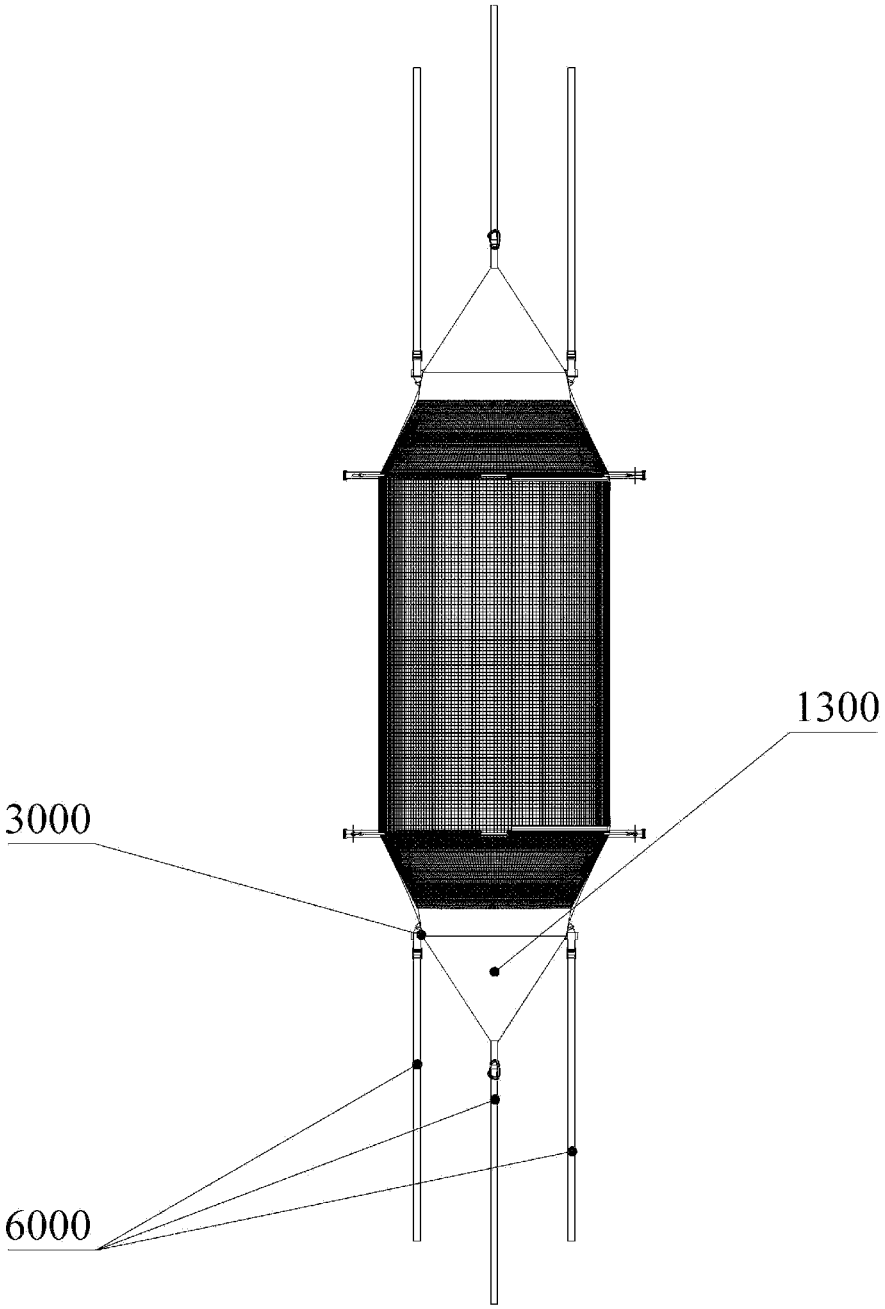
FIG. 12 shows a longitudinal schematic view of a bed-flat, structurally stable hammock without a hood.
Figure 13:
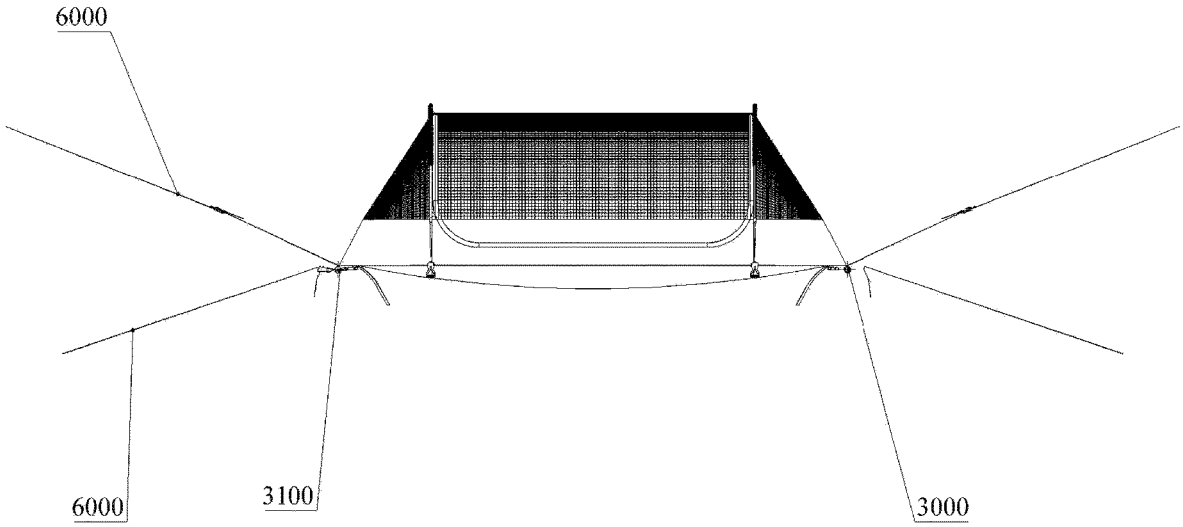
FIG. 13 shows a horizontal schematic view of a bed-flat, structurally stable hammock without a hood.

As shown in FIGS. 10 to 11, in this embodiment, a first end portion and a second end portion of the telescopic rod 3000 are each provided with connection cap 3100, and one end of the connection cap 3100 is provided with snap 3200, the first end portion of the telescopic rod 3000 is formed removably attached to the first tensioning rope 6000 via the snap 3200, and the second end portion of the telescopic rod 3000 is formed removably attached to the second tensioning rope 6000 via the snap 3200.

In this embodiment, connection cap 3100 is provided as a cap-like structure formed of plastic, an inner diameter of connection cap 3100 is not less than an outer diameter of telescopic rod 3000, a ring hole is provided at one end of snap 3200, a ring band is fixed within connection cap 3100, and the ring band passes through the ring hole to cause snap 3200 to form a fixed connection with connection cap 3100. In other embodiments (not shown in the drawings), it is not limited to being formed by plastic, but can also be set up to be formed by silicone, flexible material, metal, and any other material that meets the will.

In this embodiment, the connection between connection cap 3100 and tensioning rope 6000 is not limited to the snap 3200 connection. In other embodiments (not shown in the figures), it is also possible to be provided with a screw connection, a binding connection, a sewing connection, and any other connection that meets the will to form a connection.

As shown in FIGS. 10 to 11, in this embodiment, retainer strap 3300 is provided at the other end of connection cap 3100, at least one retaining strap 4100 is provided on stowage bag 4000, and stowage bag 4000 forms a detachable attachment through retainer strap 3300 and retaining strap 4100, stowage bag 4000 defines a space that can be placed for the user to place the articles, which improves the utilization rate of the space, and enhances the practicality of the hammock.

In this embodiment, retainer strap 3300 is provided with a loop hole at one end, and the loop strap forms a fixed attachment through the loop hole. In this embodiment, the connection between connection cap 3100 and stowage bag 4000 is not limited to connection through retainer strap 3300. In other embodiments (not shown in the drawings), the connection may also be provided as a screw connection, a binding connection, a sewing connection, a connection, and any other connection method that meets the will to form the connection.

In this embodiment, stowage bag 4000 is made of a flexible, waterproof material and is detachably attached to the underside of said bed. In other embodiments, stowage bag 4000 is not limited to being formed from a flexible material, but may also be provided to be formed from a flexible material with a grid-like shape, a flexible material with a circular hole-like shape and any other material that conforms to the will.

In this embodiment, a roughly triangular structure is formed between tensioning rope 6000 and telescopic rod 3000 in the longitudinal direction, with tensioning rope 6000 providing a tensile force for telescopic rod 3000, causing telescopic rod 3000 to flatten hammock body 1000, this structure has the advantage of effectively resisting the effects of gravity and external forces on the hammock, maintaining the stability and comfort of the hammock.

Wherein the third tensioning rope 6000 has a third fixing point forming a fixed connection with the external object, the first tensioning rope 6000 has a first fixing point forming a fixed connection with the external object, and the second tensioning rope 6000 has a second fixing point forming a fixed connection with the external object, wherein the elevation of the first fixing point is not less than an elevation of catch bar portion 1004, and the elevation of the second fixing point and the third fixing point is not greater than catch bar portion 1004 the elevation of the elevation of the first fixation point.

When the first tensioning rope 6000, the second tensioning rope 6000, and the third tensioning rope 6000 form a fixed connection with an external object, the first tensioning rope 6000 forms a generally triangular structure between the first tensioning rope 6000 and the second tensioning rope 6000 and the third tensioning rope 6000, with telescopic rod 3000 being an endpoint of the triangle in the longitudinal plane.

In this embodiment, the shape of the triangle does not change w % ben the hammock is subjected to gravity or an external force, and the telescopic rod 3000 can be adjusted in length as needed to maintain the flatness of the hammock body 1000. In addition, since the triangular structure can spread out the pressure of tensioning rope 6000 on telescopic rod 3000, damage to telescopic rod 3000 due to excessive bending can be avoided. This structure can make the structure of the hammock more stable and the bed surface flatter, so that it is less likely to produce dents when the user uses the hammock.

As shown in FIGS. 1 to 10, in this embodiment, insect proof tent 1100 is formed from a flexible material and has a grid-like body, wherein insect proof tent 1100 is detachably attached to the top of hammock body 1000. Specifically, insect proof tent 1100 is fixedly attached to guardrail department 1200, wherein insect proof tent 1100 corresponds to guardrail department 1200 and forms a fixed connection by ways of stitching.

In this embodiment, insect proof tent 1100 is a body formed from a flexible material and having a grid-like shape. This structure of insect proof tent 1100 allows the user to breathe while preventing the user from being infested by mosquitoes or other small animals during use.

In other embodiments (not shown in the drawings), it is not limited to a body formed from a flexible material and having a grid-like shape, but can also be provided as a body with a circular hole-like shape, a body with a polygonal shape, a body with an oval-like shape, and a body with any other geometrical shape that conforms to the will.

Specifically, one end of insect proof tent 1100 overlaps with one end of guardrail department 1200 using a stitched secured connection. In this embodiment, the stitching is machine stitching, and in some embodiments, may also be manual stitching. In this embodiment, the connection is a stitched connection. In some embodiments, the connection method may also be set up as one-piece molding. Velcro, bonding and any other connection method that meets the wishes.

As shown in FIGS. 2 to 10, in this embodiment, guardrail department 1200 corresponds to hammock body 1000 and forms a fixed connection by ways of sewing. The setting of guardrail department 1200 can protect the user from being injured by accidentally tumbling down during use.

In this embodiment, the shape of the end of guardrail department 1200 away from insect proof tent 1100 correspondingly overlaps with the shape of hammock body 1000 and forms a fixed connection by sewing. In this embodiment, the sewing method is machine sewing, and in some embodiments, it may also be manual sewing. In this embodiment, the connection ways are a stitched connection. In some embodiments, the connection method may also be set up as one-piece molding, Velcro, bonding and any other connection method that meets the wishes.

As shown in FIGS. 2 to 10, in this embodiment, the hammock further comprises at least one flexible rod 2000, with at least one support section 1101 provided at each end of the insect proof tent 1100, wherein each end of the flexible rod 2000 is received by the support section 1101.

In this embodiment, two sets of symmetrically distributed support section 1101 are provided at each end of the outer periphery of the insect proof tent 1100, the support section 1101 and the insect proof tent 1100 are formed of the same material, the support section 1101 is fixedly connected to the insect proof tent 1100, and the inner surface of the support section 1101 defines a space for receiving the flexible rod 2000.

In this embodiment, the support section 1101 and insect proof tent 1100 form a fixed connection by sewing. In this embodiment, the stitching is machine stitching, and in some embodiments, may also be manual stitching. In some embodiments, the connecting ways may also be set up as one-piece molding, Velcro, bonding and any other connecting ways that meets the wishes.

In other embodiments (not shown in the drawings), the inner periphery of the can be provided. In this embodiment, support section 1101 is set in two groups, and in other embodiments (not shown in the drawings), it can be set in one group, three groups, four groups and any other number of groups in accordance with the will. In other embodiments (not shown in the figures), it is not limited to being formed with the same kind of material, but can also be set up as a sturdy flexible material, and any other material that conforms to the will.

As shown in FIGS. 2 to 10, in this embodiment, flexible rod 2000 is provided with retaining head 2100 at each end, hammock body 1000 is provided with at least one mutually corresponding stationary section 1001 on each side, stationary section 1001 is provided with fixing hole 1002 not smaller than retaining head 2100, and flexible rod 2000 is formed removably attached to hammock body 1000 and insect proof tent 1100 by ways of support section 1101 and fixing hole 1002.

In this embodiment, the flexible rod 2000 is set up to increase the stability and spaciousness of the hammock. In this embodiment, one flexible rod 2000 is provided as a complete resilient rod. In other embodiments, a flexible rod 2000 is not limited to being set as a complete resilient rod, but may also be set as a plurality of resilient rods spliced together to form a flexible rod 2000, which structure saves the space required for the flexible rod 2000 when storing.

In this embodiment, flexible rod 2000 is provided as two rods. In other embodiments (not shown in the drawings), it is not limited to two rods, but can be set up as one, three, four and any other number of rods as desired.

In this embodiment, retaining head 2100 is provided as a cylindrical structure with two thick ends and a thin center, which facilitates the fitting of fixing hole 1002 to retaining head 2100. In other embodiments (not shown in the figures), not limited to a cylindrical shape, it may be set up as a square, a circle, an oval, and other arbitrary geometric shapes in accordance with the will.

In this embodiment, two sets of stationary section 1001 corresponding to the position support section 1101 are provided on each side of hammock body 1000, stationary section 1001 being formed of a strong flexible material and fixedly connected to hammock body 1000, stationary section 1001 is also provided with a triangular shape reinforcement division 1003 at the connection with hammock body 1000, reinforcement division 1003 being formed of a strong flexible material, reinforcement division 1003 being fixedly connected to hammock body 1000 on one side, stationary section 1001 overlapping and fixedly connected to reinforcement division 1003 along the centerline of that side, reinforcement division 1003 overlapping and fixedly connected.

In this embodiment, the connection between hammock body 1000 and stationary section 1001, the connection between hammock body 1000 and reinforcement division 1003, and the connection between stationary section 1001 and reinforcement division 1003 are all stitched connections. In this embodiment, the sewing ways is machine sewing, and in some embodiments, may also be manual sewing. In this embodiment, the connection ways are a stitched connection. In some embodiments, the connection method may also be set up as one-piece molding, Velcro, bonding and any other connection method that meets the wishes.

In this embodiment, two sets of retaining ear 1201 corresponding to the position of support section 1101 are provided on each side of guardrail department 1200, and hook 1202 provided on retaining ear 1201, and hook 1202 is used to receive flexible rod 2000.

In this embodiment, retaining ear 1201 is formed from a strong flexible material, one end of retaining ear 1201 is formed with guardrail department 1200 to be fixedly connected by stitching, hook 1202 is provided with a ring hole, and the other end of retaining ear 1201 is fixedly connected with hook 1202 by stitching. In this embodiment, the stitching is machine stitching, and in some embodiments, may also be manual stitching. In some embodiments, the connection method may also be set up as one-piece molding, Velcro, bonding and any other connection method that meets the wishes.

When flexible rod 2000 is configured to hammock body 1000, guardrail department 1200, and insect proof tent 1100, flexible rod 2000 is sequentially passed through hook 1202 of retaining ear 1201, support section 1101 of insect proof tent 1100, and hook 1202 of retaining ear 1201 on the other side, and then retaining head 2100 on one end of flexible rod 2000 is inserted first into fixing hole 1002 of a stationary section 1001, and retaining head 2100 on the other end of flexible rod 2000 is inserted first into fixing hole 1002 of the corresponding stationary section 1001 on the other side, to complete the flexible rod 2000 installation.

As shown in FIGS. 2 to 5, in this embodiment, insect proof tent 1100 and guardrail department 1200 are provided with at least one opening A 1102 defining an access channel.

In this embodiment, the closure or opening of opening A 1102 is controlled by installing a zipper at opening A 1102. In other embodiments (not shown in the figures), the ways of controlling the opening are not limited to zippers, but may be provided as Velcro, elastic bands, and any other structure that meets the wishes.

In this embodiment, insect proof tent 1100 and guardrail department 1200 are provided with one opening A 1102, in other embodiments (not shown in the figures), and are provided with openings that are not limited to one, but may be provided as two, three, four, and any other number that meets the will.

As shown in FIG. 1, in this embodiment, hood 5000 is provided with at least one opening B 5100 that defines an access channel.

In this embodiment, the closure or opening of opening B 5100 is controlled by installing a zipper at opening B 5100. In other embodiments (not shown in the drawings), the ways of controlling the opening are not limited to a zipper, but may be provided with Velcro, elastic bands, and any other structure that meets the wishes.

In this embodiment, hood 5000 is provided with one opening B 5100, in other embodiments (not shown in the figures), and is provided with openings that are not limited to one, but may be provided as two, three, four, and any other number that meets the will.

As shown in FIGS. 1 to 4, in this embodiment, the ends of hood 5000 are provided separately, and the ends of hood 5000 are over stopper to form a detachable attachment with the ends of hammock body 1000, hood 5000 is made of a waterproof and heat-insulating flexible material, which can provide a shelter for the user to avoid the user from being wetted by the rain or sunburned by the sun.

In this embodiment, formed from a waterproof flexible fabric blank, one end of which forms a fixed connection with hood 5000, and the other end of which snap 3200*s* into stopper of hammock body 1000 to form a connection.

In this embodiment, the connection to hood 5000 is a stitched connection. In this embodiment, the sewing ways is machine sewing, and in some embodiments, may also be manual sewing. In this embodiment, the connection is a stitched connection. In some embodiments, the connecting ways may also be set up as one-piece molding, Velcro, bonding and any other connecting ways in accordance with the will.

As shown in FIGS. 1 to 4, in this embodiment, retaining head 2100 is provided with retainer strap 3300 at an end near fixing hole 1002, hood 5000 is provided with retaining strap 4100, and hood 5000 and hammock body 1000 form a detachable attachment through retainer strap 3300 and retaining strap 4100.

In other embodiments (not shown in the drawings), the attachment to hammock body 1000 is not limited to forming a connection through and, but may also be provided to form a connection through a sewing connection, a screw connection, a rivet connection, and any other connection that conforms to the will.

When hood 5000 is installed, a connection is formed to the hammock by connecting hood 5000 through stopper and, and retainer strap 3300 and retaining strap 4100.

The present invention also provides a method of using a hammock comprising providing at least one hammock body 1000, at least two telescopic rod 3000*s*, and a plurality of tensioning rope 6000*s;*

The method comprises using two tensioning rope 6000*s* to connect to each end of the hammock body 1000, wherein one end of the two-tensioning rope 6000*s* away from the hammock body 1000 forms a fixed connection with an external object at each end, wherein a fixing point at which the tensioning rope 6000 forms a fixed connection with the external object is defined as a third fixing point;

Two roots telescopic rod 3000 are provided at each end of the hammock body 1000.

Connecting two roots tensioning rope 6000 to each end of one telescopic rod 3000 using two roots tensioning rope 6000 respectively, wherein one end of each of the two roots tensioning rope 6000 away from the telescopic rod 3000 forms a fixed connection with an external object, wherein a fixing point defining the fixing point at which the two roots tensioning rope 6000 form a fixed connection with the external object is a first fixing point and a second fixing point:

Tensioning the plurality of roots tensioning rope 6000 so that hammock body 1000 forms a flat and not easily concave plane, wherein the line between the first fixing point, the second fixing point and the third fixing point forms a generally triangular structure.

Specifically, two of the tensioning rope 6000 connected to the hammock body 1000 are each bound to a trunk of a corresponding tree at an end away from the hammock body 1000, and four of the tensioning rope 6000 connected to the telescopic rod 3000 are each bound to a root of a corresponding tree at an end away from the telescopic rod 3000.

Specifically, at least one stopper is provided at each end of the hammock body 1000, wherein each end of the hammock body 1000 forms a detachable connection to the two-tensioning rope 6000*s* connected to the trunks of the trees, respectively, via the stopper.

Specifically, the ends of hammock body 1000 are each provided with catch bar portion 1004, wherein the two roots telescopic rod 3000 are each threaded through the catch bar portion 1004 for connection.

Specifically, the hammock further comprises flexible rod 2000, with retaining head 2100 provided at each end of flexible rod 2000, fixing hole 1002 having an inner diameter not less than an outer diameter of retaining head 2100 provided on each side of hammock body 1000, and at least a hook 1202 provided in hammock body 1000, wherein the flexible rod 2000 is formed removably connected to the hammock body 1000 through the retaining head 2100, fixing hole 1002 and hook 1202.

Specifically, each end of telescopic rod 3000 is provided with a connection cap 3100, and one end of connection cap 3100 is provided with a snap 3200, wherein the telescopic rod 3000 is detachably connected to the tensioning rope 6000 secured to the tree root through the snap 3200.

Specifically, retainer strap 3300 is provided at the other end of connection cap 3100, and the hammock further comprises stowage bag 4000, with at least one strip of retaining strap 4100 provided on the stowage bag 4000, wherein the stowage bag 4000 is connected to the hammock body 1000 via the retainer strap 3300 and the retaining strap 4100.

Specifically, the hammock further comprises hood 5000, hood 5000 is provided with connection zone 5200 at each end, hammock body 1000 is further provided with retainer strap 3300, and hood 5000 is provided with retaining strap 4100, wherein the hood 5000 is formed removably connected to the hammock body 1000 via stopper, connection zone 5200, retainer strap 3300, and retaining strap 4100.

The terms "comprising." "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" ways one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting.

The various features and processes described above may be used independently of one another, or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

The invention has now been described in detail for the purposes of clarity and understanding. But those skilled in the art will appreciate that certain changes and modifications may be practiced within the scope of the appended claims.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

What is claimed is:

1. A bed-flat, structurally stable hammock, it comprising:

a hammock body, said hammock body having connection portion provided at each end of said hammock body, a third tensioning rope forming a fixed connection with an external object, wherein said connection portion has a decreasing transverse width in a direction away from said bed; and wherein said connection portion is further provide with a catch bar portion, said catch bar portion forming a fixed connection with said connection portion and being provided parallel to ends of said hammock body; and at least two telescopic rods, each of said two telescopic rods being threaded through said catch bar portion, wherein said telescopic rod of said at least two telescopic rods has a first end and a second end opposite said first end, said first end being removably coupled to a first tensioning rope, said second end being removably coupled to a second tensioning rope, and said first tensioning rope and said second tensioning rope each forming a fixed connection to said external object; and wherein said third tensioning rope has a third fixing point forming a fixed connection to said external object, said first tensioning rope has a first fixing point forming a fixed connection to said external object, and said second tensioning rope has a second fixing point forming a fixed connection to said external object, wherein said third fixing point is at an elevation not less than an elevation of said catch bar portion, said first fixing point and a second fixation point are at an elevation no greater than the elevation of said catch bar portion; and when said first tensioning rope, said second tensioning rope and said third tensioning rope form a fixed connection with said external object, a triangular structure is formed between said first tensioning rope and said second tensioning rope and said third tensioning rope; and when the ends of said hammock body are tensioned by said first tensioning rope, said second tensioning rope and said third tensioning rope, respectively, said hammock body forms a bed plane which is not recessed.

2. The bed-flat, structurally stable hammock according to claim 1, wherein said connection portion is triangular in shape.

3. The bed-flat, structurally stable hammock according to claim 2, further comprises at least an insect proof tent, said insect proof tent being formed of a flexible material and having a grid-like body, wherein said insect proof tent is removably attached to a top of said hammock body.

4. The bed-flat, structurally stable hammock according to claim 3, further comprises at least one flexible rod, said insect proof tent being provided with at least one stationary section at each end of said insect proof tent, wherein each end of said flexible rod is received by said stationary section.

5. The bed-flat, structurally stable hammock according to claim 4, wherein an outer surface of said insect proof tent is removably attached to said flexible rod such that said insect proof tent has a arch-shaped cross-section.

6. The bed-flat, structurally stable hammock according to claim 5, wherein the outer surface of said insect proof tent is provided with a support section, said flexible rod being threaded into said support section.

7. The bed-flat, structurally stable hammock according to claim 1, wherein said hammock body is further provided with a guardrail department, said guardrail department having a solid outer surface and continuously molded around an outer perimeter of said hammock body.

8. The bed-flat, structurally stable hammock according to claim 1, further comprises a hood, said hood being formed from a waterproof, flexible fabric blank and removably attached to a top of said hammock body to form a shelter for said hammock body.

9. The bed-flat, structurally stable hammock according to claim 1, further comprises at least one stowage bag, said stowage bag being formed from a flexible, waterproof material and removably attached to an underside of said bed.

10. The bed-flat, structurally stable hammock according to claim 9, wherein said telescopic rod is provided with a connection cap at each end of said telescopic rod, said connection cap is provided with a snap at one end of said connection cap, and said telescopic rod forms a detachable connection with said first tensioning rope and second tensioning rope through said snap.

11. The bed-flat, structurally stable hammock according to claim 10, wherein said connection cap is provided with a retainer strap at an other end, said stowage bag is provided with at least one strip of retaining strap, and said stowage bag is formed removably connected to said retaining strap via said retainer strap and said retaining strap.

12. A bed-flat, structurally stable hammock, it comprising:

a hammock body, said hammock body is provided with a connection portion at each end of said hammock body, said connection portion having a triangular cross-section, wherein said connection portion is connected to a third tensioning rope at an end away from said bed, said third tensioning rope forming a fixed connection with an external object; and said connection portion is further provided below said connection portion with catch bar portion, said catch bar portion forming a fixed connection with said connection portion and being provided parallel to each end of said hammock body; and at least two telescopic rods, each of said two said telescopic rods being threaded into said catch bar portion, wherein said telescopic rod has a first end and a second end opposite said first end, said first end being removably coupled to a first tensioning rope, said second end being removably coupled to a second tensioning rope, and said first tensioning rope and said second tensioning rope each forming a fixed connection with an external object; and wherein said third tensioning rope has a third fixing point forming a fixed connection to the external object, said first tensioning rope has a first fixing point forming a fixed connection to the external object, and said second tensioning rope has a second fixing point forming a fixed connection to the external object, wherein an elevation of said third fixing point is not less than the elevation of said catch bar portion, and wherein the first fixing point and said second fixing point have an elevation are not greater than the elevation of said catch bar portion; and when said first tensioning rope, said second tensioning rope and said third tensioning rope form a fixed connection with said external object, a triangular structure is formed between said first tensioning rope and said second tensioning rope and said third tensioning rope; and when the ends of said hammock body are tensioned by said first tensioning rope, said second tensioning rope and said third tensioning rope, respectively, said hammock body forms a bed plane.

13. A method of using a hammock, includes providing at least one hammock body, at least two telescopic rods, and a plurality of tensioning ropes, the hammock body having a connection portion provided at each end of said hammock body, and the connection portion is provided with a catch bar portion; and the method comprising:

connecting two said tensioning rope to each end of said hammock body using two said tensioning rope, wherein one end of each of the two said tensioning rope away from said hammock body forms a fixed connection with an external object at each end, wherein a fixing point at which the said tensioning rope forms a fixed connection with said external object is defined as a third fixing point; and setting two of said telescopic rod at each end of said hammock body; and connecting two of said tensioning rope to each end of one of said telescopic rod using two of said tensioning rope respectively, wherein one end of each of said two of said tensioning rope away from said telescopic rod forms a fixed connection with said external object, wherein the fixing points at which said two of said tensioning rope form a fixed connection with said external object are defined as a first fixing point and a second fixing point, wherein said third fixing point is at an elevation not less than an elevation of the catch bar portion, said first fixing point and a second fixation point are at an elevation no greater than the elevation of said catch bar portion; and tensioning a number of said tensioning rope so that said hammock body forms a flat and non-depressed plane, wherein the line between said first fixing point, said second fixing point and said third fixing point forms a triangular structure.

14. The method of using a hammock according to claim 13, wherein two of said tensioning rope connected to said hammock body are each tied to a trunk of a corresponding tree at an end away from said hammock body, and four of said tensioning rope connected to said telescopic rod are each tied to a root of a corresponding tree at an end away from said telescopic rod.

15. The method of using a hammock according to claim 14, wherein at least one stopper is provided at each end of said hammock body, wherein each end of said hammock body forms a detachable connection to two of said tensioning rope connected to the trunks of the trees through said stopper.

16. The method of using a hammock according to claim 15, wherein each end of said hammock body is provided with a catch bar portion, wherein two said telescopic rod are each threaded through said catch bar portion for connection.

17. The method of using a hammock according to claim 16, wherein said hammock further comprises a flexible rod, said flexible rod being provided with a retaining head at each end, said hammock body being provided on each side with a fixing hole having an inner diameter not less than an outer diameter of said retaining head, said hammock body being further provided with at least a hook, wherein passing said flexible rod through said retaining head, said flexible rod, said fixing hole and said hook are connected, said fixing hole and said hook forming a removable connection with said hammock body.

18. The method of using a hammock according to claim 17, wherein said telescopic rod is provided with a connection cap at each end of said telescopic rod, and said connection cap is provided with a snap at one end of said connection cap, wherein said telescopic rod is removably coupled to said tensioning rope secured to the root of a tree through said snap.

19. The method of using a hammock according to claim 18, wherein said connection cap is provided with a retainer strap at an other end, said hammock further comprising a stowage bag, said stowage bag being provided with at least one strip of retaining strap, wherein said stowage bag is connected to said hammock body through said retainer strap and said retaining strap.

20. The method of using a hammock according to claim 19, wherein said hammock further comprises a hood, said hood being provided with a connection zone at each end of said hood, said hammock body being further provided with a retainer strap, said hood being provided with retaining strap, wherein said hood is connected to said hammock body by ways of said stopper, said connection zone, said retainer strap and said retaining strap in a removable connection with said hammock body to form a detachable connection.

* * * * *